US012460848B2

(12) United States Patent
Mayr et al.

(10) Patent No.: US 12,460,848 B2
(45) Date of Patent: Nov. 4, 2025

(54) COOLING UNIT FOR COLD AIR GENERATION

(71) Applicant: 3con Anlagenbau GmbH, Ebbs (AT)

(72) Inventors: Christian Mayr, Söll (AT); Daniel Gruber, Söll (AT)

(73) Assignee: 3con Anlagenbau GmbH, Ebbs (AT)

( * ) Notice: Subject to any disclaimer, the term of this patent is extended or adjusted under 35 U.S.C. 154(b) by 118 days.

(21) Appl. No.: 18/308,564

(22) Filed: Apr. 27, 2023

(65) Prior Publication Data

US 2023/0349607 A1 Nov. 2, 2023

(30) Foreign Application Priority Data

Apr. 28, 2022 (EP) ..... 22170496

(51) Int. Cl.

| | |
|---|---|
| ***F25B 47/00*** | (2006.01) |
| ***F28F 17/00*** | (2006.01) |
| *F25C 3/04* | (2006.01) |

(52) U.S. Cl.

CPC ..... *F25B 47/00* (2013.01); *F28F 17/00* (2013.01); *F25C 3/04* (2013.01)

(58) Field of Classification Search

CPC ... F28G 3/10; F28G 15/04; F28G 1/02; F25D 21/065; F25B 47/00; F28D 1/053; F25C 1/142; F28F 17/00

See application file for complete search history.

(56) References Cited

U.S. PATENT DOCUMENTS

2006/0037736 A1 2/2006 Heyman
2008/0000620 A1* 1/2008 Tao ..... F28D 7/1607 165/142
2011/0155174 A1* 6/2011 Moll ..... F28G 1/163 226/188
2012/0260681 A1 10/2012 Famme et al.
2022/0057151 A1* 2/2022 Hastey ..... F28G 15/02

FOREIGN PATENT DOCUMENTS

| | | | | |
|---|---|---|---|---|
| CH | 237257 A | | 4/1945 | |
| CN | 108131886 A | * | 6/2018 | ..... F25D 21/065 |
| JP | H0659769 U | | 8/1994 | |
| KR | 100760661 B1 | * | 9/2007 | ..... F28F 17/00 |
| WO | WO-2021130952 A1 | * | 7/2021 | ..... F28G 1/08 |

OTHER PUBLICATIONS

18308564_2024-11-13_WO_2021130952_A1_M.pdf (Year: 2021).*
18308564_2024-11-14_KR_100760661_B1_M.pdf (Year: 2007).*
18308564_2024-11-15_CN_108131886_A_M.pdf (Year: 2018).*
Notice of Substantive Examination Report with English Translation for Saudi Arabia Application No. 123447004, 11 pages, dated Jul. 22, 2024.

* cited by examiner

*Primary Examiner* — Frantz F Jules
*Assistant Examiner* — Martha Tadesse
(74) *Attorney, Agent, or Firm* — Nixon & Vanderhye P.C.

(57) ABSTRACT

A cooling unit for cold air generation, in particular for snow-making systems, has a mechanically operating de-icing device which comprises at least one rotary shaft (6), which extends between two tube layers (5) transversely to the refrigerant guide tubes and is displaceable in the longitudinal direction of the refrigerant guide tubes (4), and a rotary drive for rotating the rotary shaft (6). The removal elements (16) are designed as rotary elements which are fastened to the rotary shaft (6) and which remove the ice and frost build-up from the refrigerant guide tubes (4) by means of a rotary movement.

13 Claims, 7 Drawing Sheets

COOLING UNIT FOR COLD AIR GENERATION

CROSS RELATED APPLICATION

Figure 1:
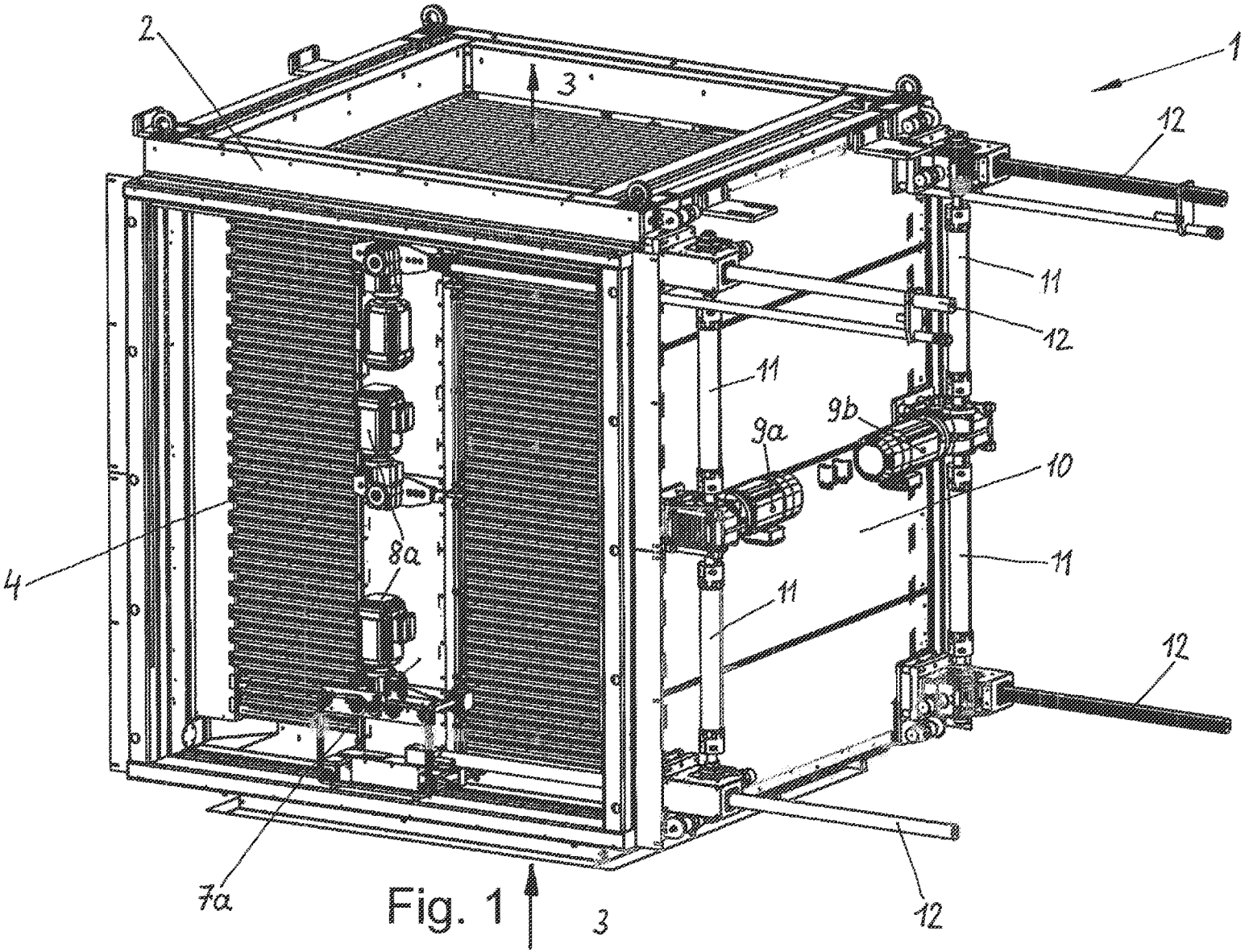

This application claims priority to European Patent Application EP 22 170 496.8, filed Apr. 28, 2022, the entire contents of which is hereby incorporated by reference.

The invention relates to a cooling unit for cold air generation, in particular for snow-making systems, according to the preamble of claim 1.

Snow-making systems are known to produce artificial snow that can be used, for example, for ski slopes. Snow-making systems work by spraying water into a cold air stream, which cools the water droplets accordingly and converts them into snow or snow crystals and ice crystals.

Cooling units (heat or cold exchangers) in the form of fin-type cooling units are known for cooling the airflow. Such fin-type cooling units have a very large number of fins that are strongly cooled by means of a suitable refrigerant, which creates a large cooling surface for the passing airflow.

Icing is a major problem with cooling units. As icing increases, the efficiency of a cooling unit is greatly reduced. This can lead to a complete functional failure of the cooling unit. In the case of fin-type cooling units, an attempt is made to counter this problem, for example, by providing two such cooling units, of which only one is used during operation. If one cooling unit is out of order, the second cooling unit is put into operation while the iced cooling unit is de-iced. However, this principle is associated with high costs and a large space requirement. For applications where the air to be cooled has a high humidity, this principle cannot be used economically, as the icing of the cooling unit would occur too quickly. This is especially true for snow-making systems, where the air humidity is often between 65% and 100%.

Document CH 237257 A describes a cooling unit according to the preamble of claim 1. This known cooling unit has a device for mechanically removing the frost build-up from refrigerant guide tubes, wherein a scraping device acting simultaneously on two adjacent tube layers is provided. The scraping device there comprises a scraper shaft which is provided with scraping blades, is manually displaceable along the refrigerant guide tubes and scrapes off the frost build-up by pulling of the scraping device back and forth. However, such back-and-forth pulling of the scraper device is laborious, cumbersome and time-consuming.

The object of the present invention is therefore to create a cooling unit for cold air generation, which is also particularly suitable for the cooling of air that has high humidity and which enables particularly effective, fast, and energy- and power-saving de-icing.

This object is achieved according to the invention by a cooling unit having the features of claim 1. Advantageous embodiments of the invention are described in the further claims.

In the cooling unit according to the invention, the de-icing device comprises at least one rotary shaft, which extends between two tube layers and is displaceable in the longitudinal direction of the refrigerant guide tubes, and a rotary drive for rotating the rotary shaft. The removal elements are designed here as rotary elements fastened to the rotary shaft, which remove the ice and frost build-up from the refrigerant guide tubes by means of a rotary movement.

The term "ice" or "ice and frost build-up" is used in the broadest sense within the scope of the invention and is intended to encompass all types of frozen substances that may form and deposit on the refrigerant guide tubes, including in particular snow.

In the de-icing device according to the invention, the ice and frost build-up is thus removed by a type of milling movement, the removal elements being rotated by a rotary drive about an axis of rotation which runs transversely to the longitudinal axis of the refrigerant guide tubes. The rotating removal elements are then moved along the refrigerant guide tubes in such a way that the refrigerant guide tubes are de-iced over their entire length.

In this way, the de-icing of the cooling unit according to the invention can be carried out fully automatically, quickly and effectively as well as with relatively low energy expenditure. Since the removal elements do not remove the ice and frost build-up by a pure scraping movement in the longitudinal direction of the refrigerant guide tubes, but by a rotary movement, the displacement of the rotary shaft(s) along the refrigerant guide tubes is associated with a relatively low expenditure of energy. The de-icing can therefore be carried out in an energy-saving manner. Furthermore, the de-icing device according to the invention can also be used in particular for cooling units that operate in an environment with high humidity and that usually ice up very quickly.

Preferably, the removal elements have contour cutting edges which form a cutting edge profile adapted to the circumference of the refrigerant guide tubes, which extends over at least one third, preferably over a range between one third and half, of the circumference of the refrigerant guide tubes. Particularly preferably, the cutting edge profile encloses half of the circumference of the refrigerant guide tubes. Preferably, the refrigerant guide tubes of two adjacent tube layers are de-iced simultaneously by means of a single rotary shaft, wherein the upper circumferential region, preferably the upper circumferential half, of the lower refrigerant guide tubes and the lower circumferential region, preferably the lower circumferential half, of the upper refrigerant guide tubes are processed simultaneously. This can reduce the number of rotary shafts and can simplify the design. The removal elements can also extend at least slightly beyond half of the tube circumference.

According to an advantageous embodiment, the removal elements are made of a metal that has a lower hardness than the refrigerant guide tubes, or the removal elements have scraper lips on which the contour cutting edges are formed and which are made of a hard plastic or hard rubber or of a metal that has a lower hardness than the refrigerant guide tubes. This prevents wear of the refrigerant guide tubes when the removal elements closely surround the refrigerant guide tubes and contact occurs between removal elements and refrigerant guide tubes due to manufacturing tolerances.

Preferably, the removal elements are designed in such a way that the contour cutting edges are at a distance of 0.5 to 3 mm, preferably 2 to 3 mm, from the refrigerant guide tubes. This makes it easy to avoid contact between the removal elements and the refrigerant guide tubes and the resulting wear, without having to keep the manufacturing tolerances very small. Surprisingly, it has also been shown that a thin layer of compacted snow or ice, which remains on the refrigerant guide tubes due to this distance, does not significantly worsen the cold transmission from the refrigerant guide tubes to the air.

The removal elements are preferably made of a steel material. Alternatively, it is also possible to make the removal elements from a plastics material, rubber, rubber-fabric materials, Kevlar, cloth or leather materials.

Alternatively, it is also possible that the removal elements are designed as brushes, preferably as round contour brushes.

According to an advantageous embodiment, the removal elements are flexibly mounted on the rotary shaft in such a way that the position of the removal elements relative to the rotary shaft can be adapted to the position of the refrigerant guide tubes. This makes it possible to compensate for tolerances of the tube arrangement and/or the removal elements.

Preferably, the rotary shaft has radially projecting retaining lugs, on which the removal elements are detachably retained. The retaining lugs can be welded to the rotary shaft, for example, while the removal elements are screwed to the retaining lugs. This makes it easy to replace the removal elements if this should be necessary, for example due to wear.

According to an advantageous embodiment, a plurality of removal elements are integrally formed in the form of a removal strip that can be fastened along the rotary shaft. Such a removal strip advantageously extends over all refrigerant guide tubes of a tube layer, i.e. over the entire width of the stack of refrigerant guide tubes, but can also extend only over a smaller number of refrigerant guide tubes of a tube layer. Alternatively, it is also possible to provide separate removal elements for each refrigerant tube of a tube layer.

According to an advantageous embodiment, the cooling unit comprises multiple tube layers arranged one above the other, between each of which a rotary shaft with removal elements is arranged, adjacent rotary shafts being arranged offset in the longitudinal direction of the refrigerant guide tubes. This allows the removal elements to pass over the refrigerant guide tubes over slightly more than half of the tube circumference without colliding with removal elements of the adjacent rotary shaft. This ensures in a simple manner that the ice or frost layer is also removed without leaving any residue in the central circumferential region of the refrigerant guide tubes.

According to an advantageous embodiment, the rotary shaft is rotatably mounted at the end on a side support arrangement which is movable in the longitudinal direction of the refrigerant guide tubes, the rotary drive being fastened to the side support arrangement and being movable together therewith.

It is particularly advantageous here if the rotary drive comprises at least one motor which drives a plurality of rotary shafts together via a transmission. For example, it is possible to drive 2 to 20, preferably 5 to 13, particularly preferably 7 to 11 rotary shafts via a single motor by means of a plurality of drive chains or toothed belts, which are coupled to each other in terms of drive via gears of the rotary shafts. Other types of transmissions, for example pure gear transmissions, and a different number of jointly driven rotary shafts are readily possible.

Preferably, the refrigerant guide tubes are radially floatingly mounted in end plates which are designed as perforated plates. Such a floating mounting enables a mutual alignment of refrigerant guide tubes and removal elements to a certain extent. Furthermore, this allows the refrigerant guide tubes to expand or contract unhindered by changes in temperature, whereby material stresses and deformations of the refrigerant guide tubes and/or end plates can be avoided. For this purpose, the refrigerant guide tubes can advantageously also be fixed in a floating manner in the longitudinal direction.

Preferably, the end plates are heated. This allows scraped ice that has got onto the end plates to be easily melted and removed if necessary.

Figure 2:
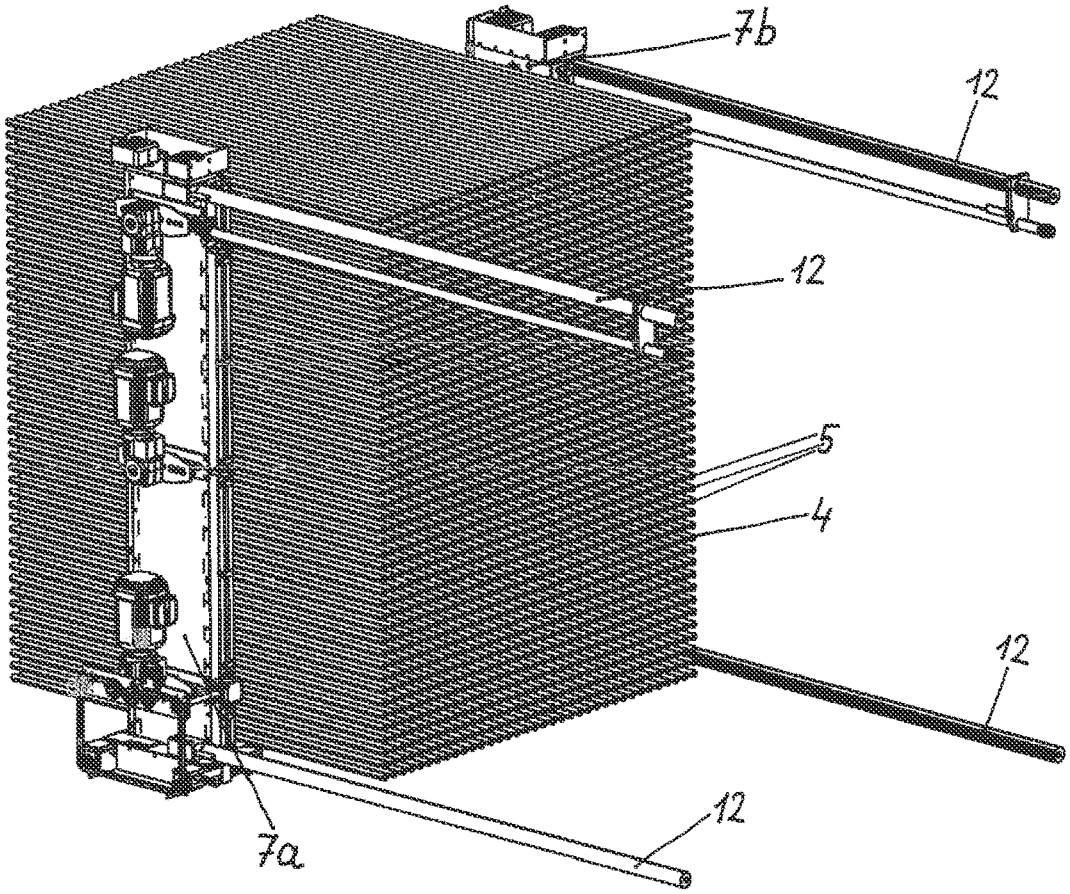
Figure 3:
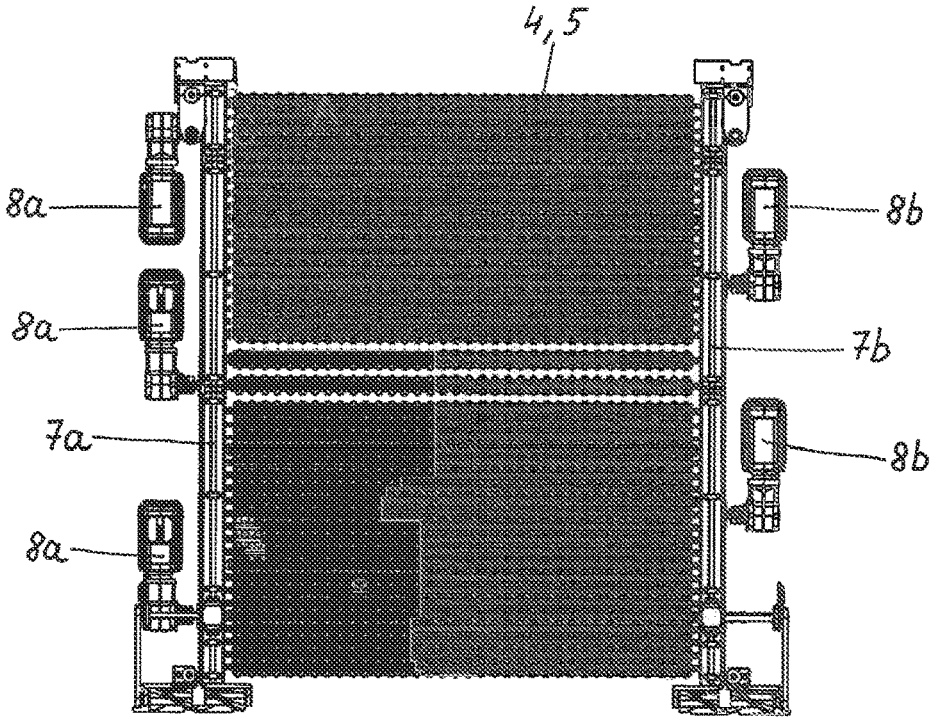
Figure 4:
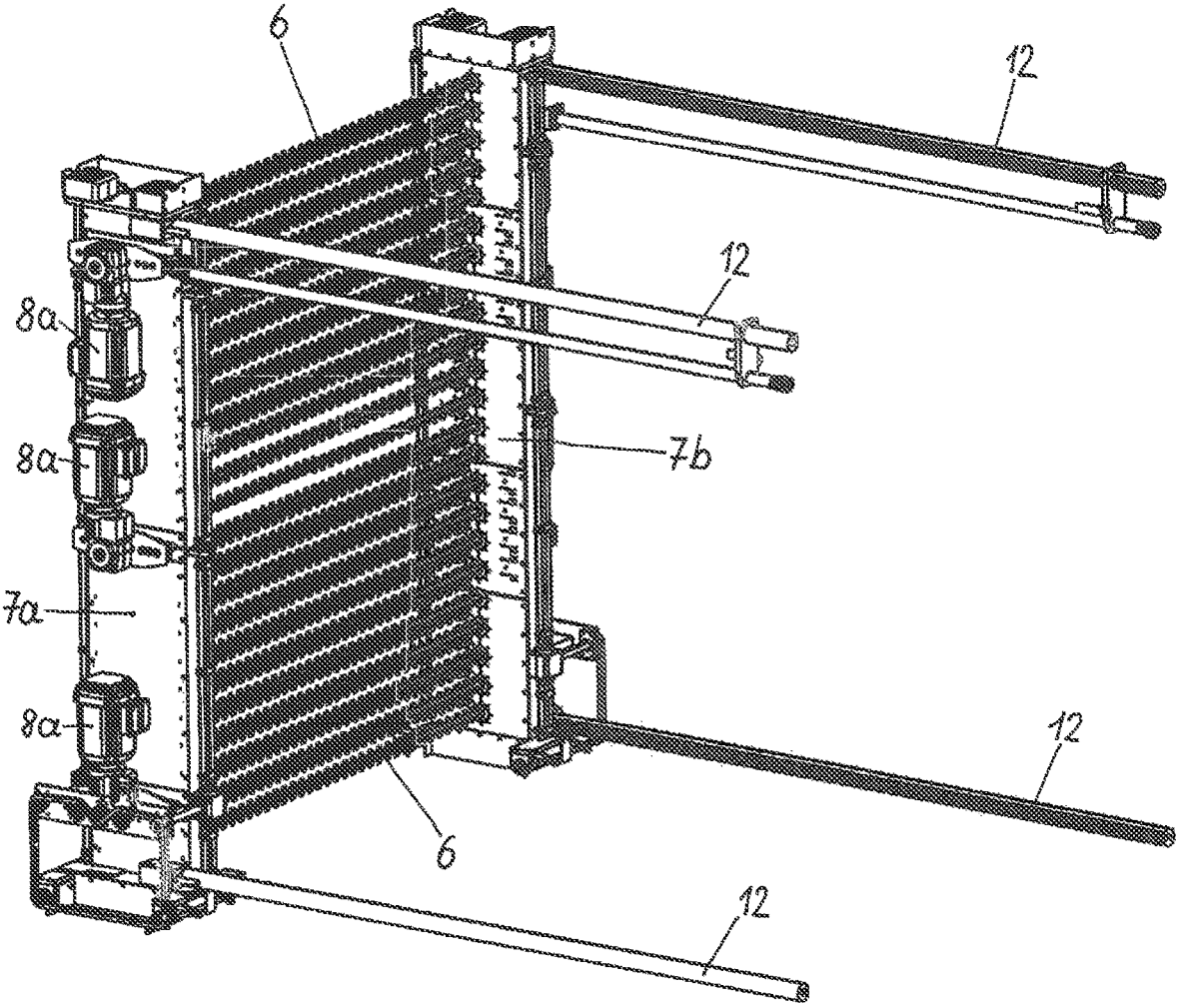
Figure 5:
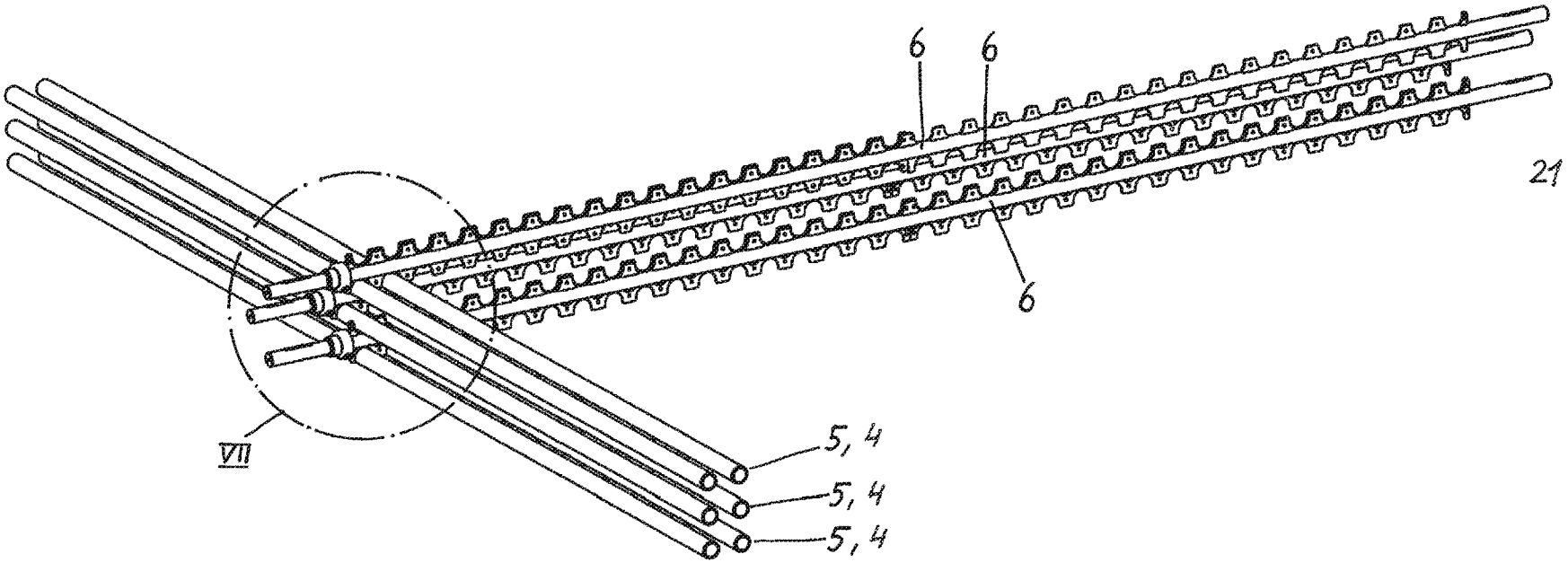
Figure 6:
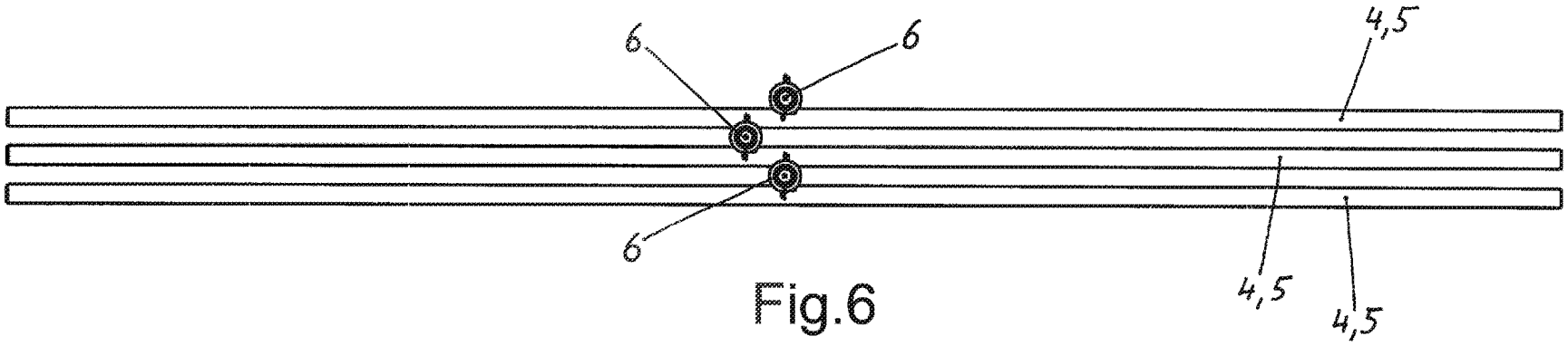
Figure 7:
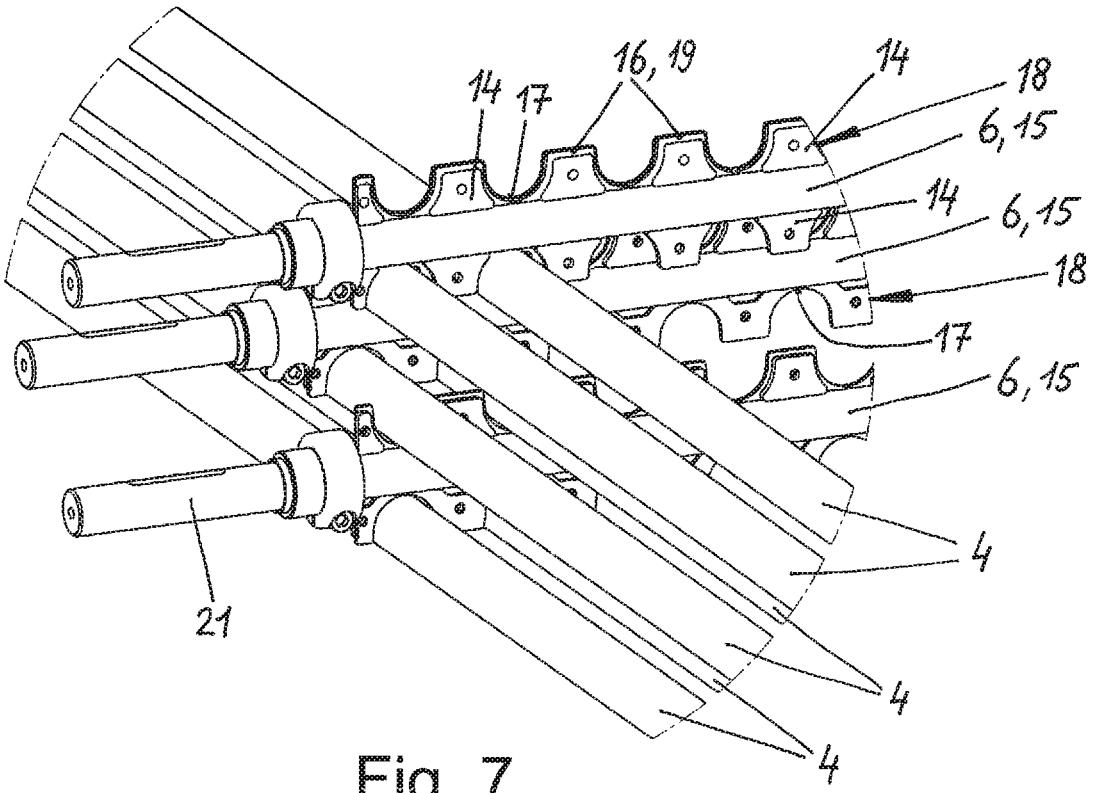
Figure 8:
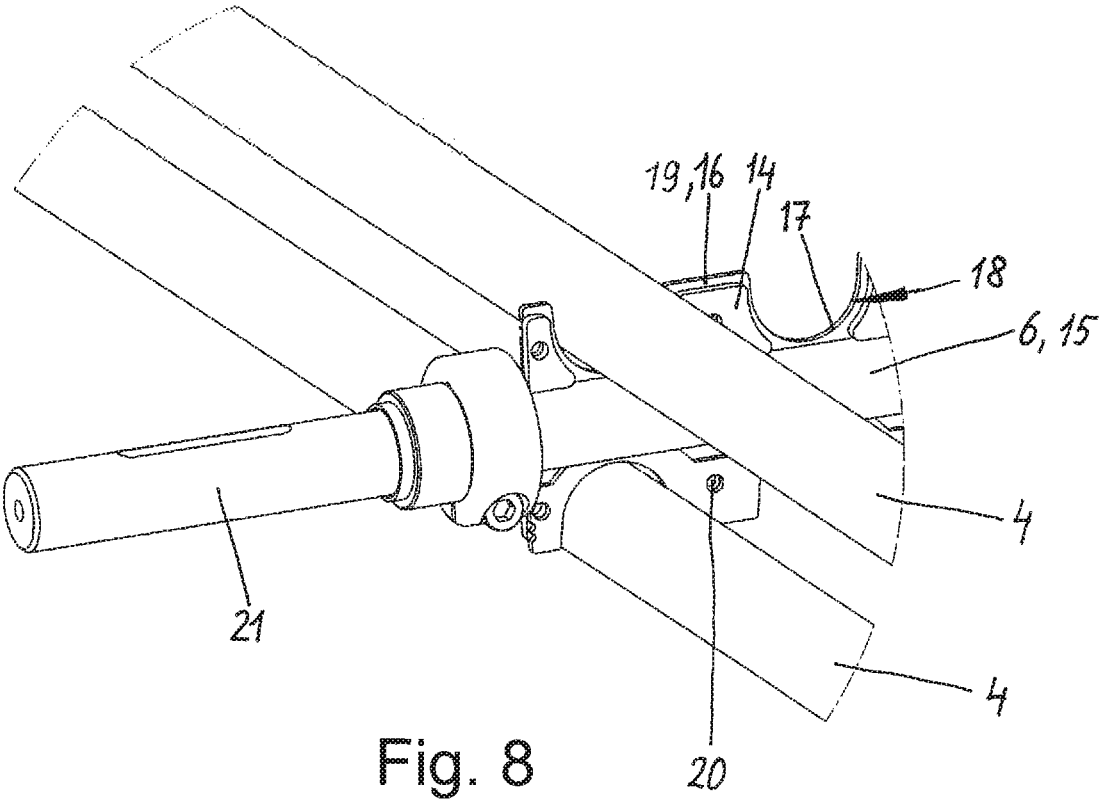
Figure 9:
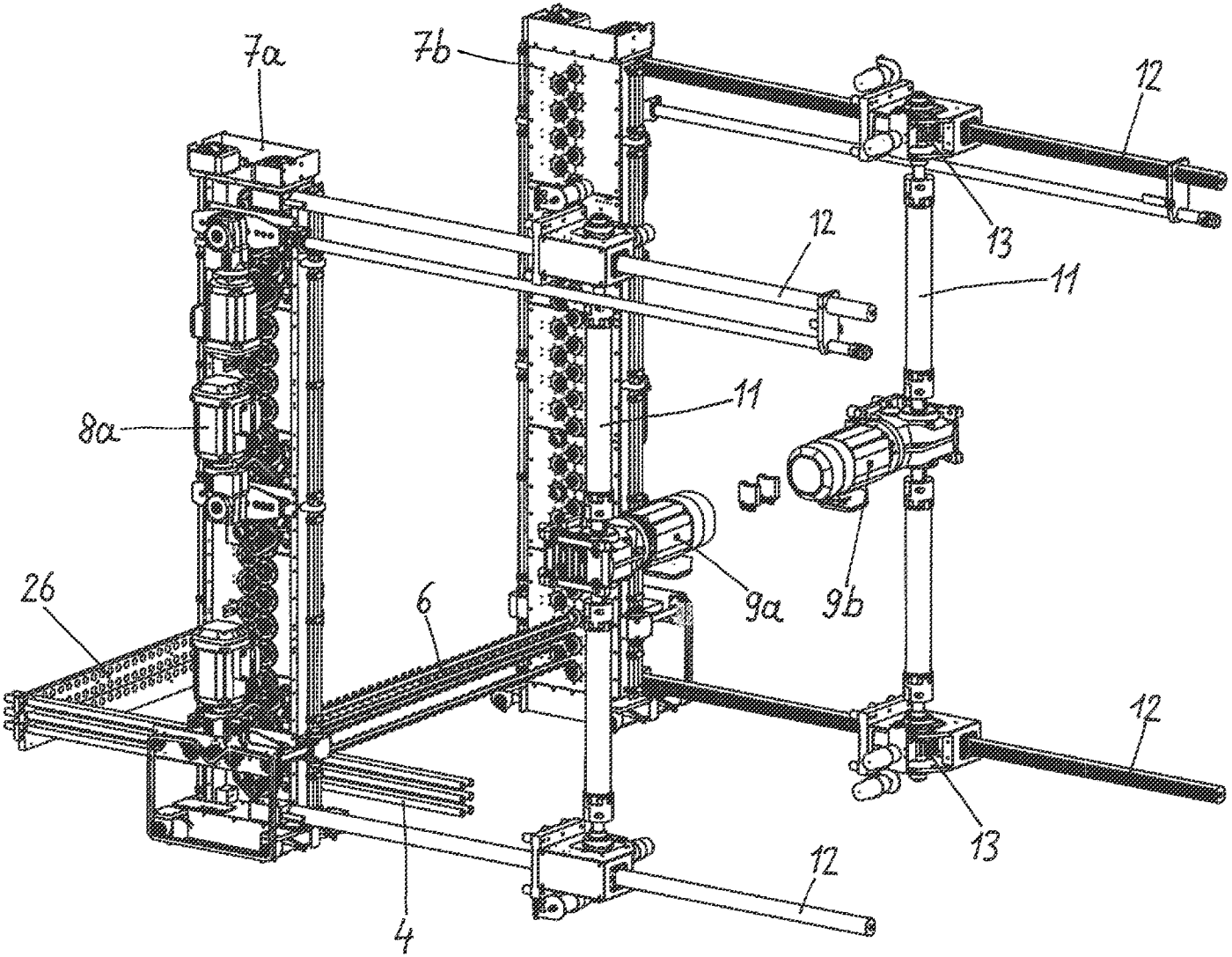
Figure 11:
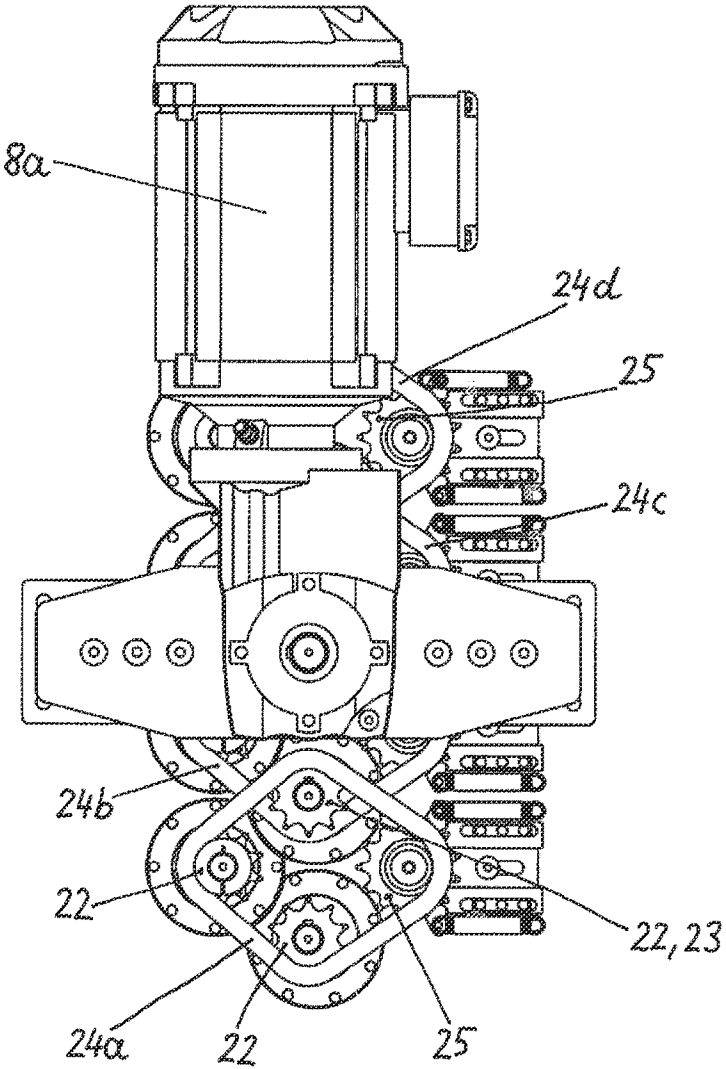
Figure 10:
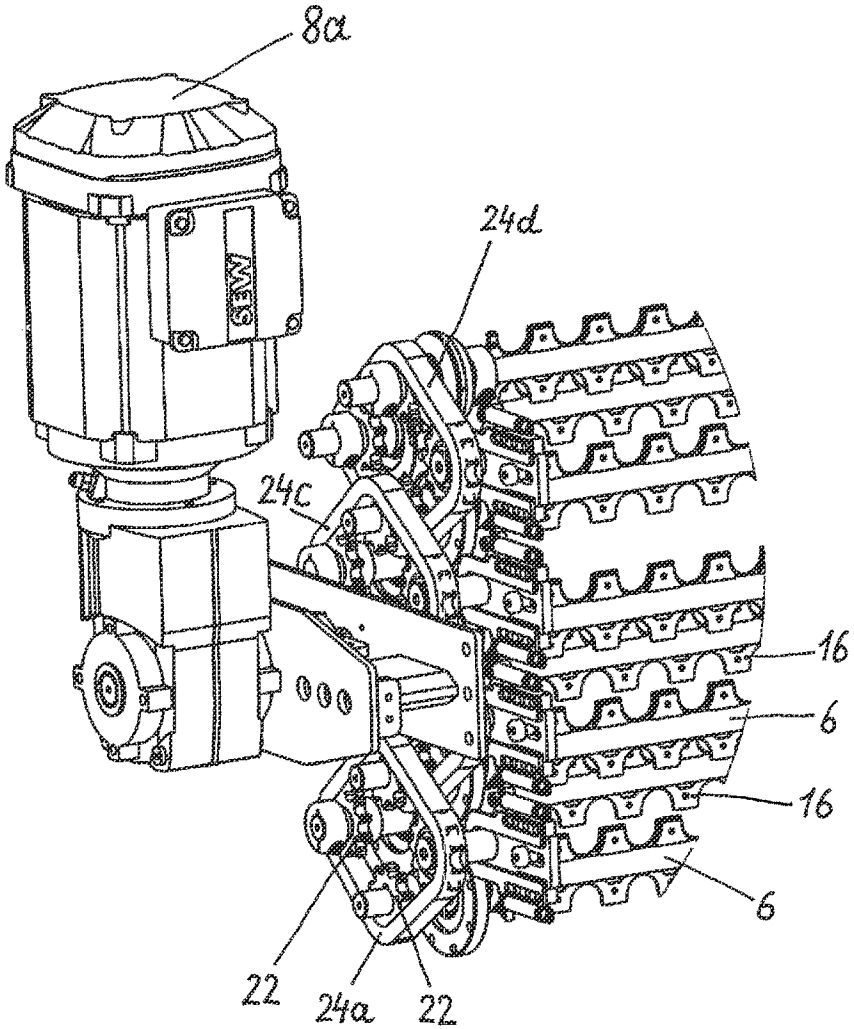

The invention is explained in greater detail below by way of example with reference to the drawings, in which:

FIG. 1: shows a three-dimensional depiction of a cooling unit according to the invention;

FIG. 2: shows the cooling unit of FIG. 1, wherein outer frame elements and the drive for moving the de-icing device along the refrigerant guide tubes have been omitted;

FIG. 3: shows a frontal view of the cooling unit of FIG. 2;

FIG. 4: shows a depiction as in FIG. 2, but without refrigerant guide tubes;

FIG. 5: shows a greatly reduced number of rotary shafts and refrigerant guide tubes for clarity, wherein three rotary shafts arranged between three layers of tubes, each with two refrigerant guide tubes, are shown;

FIG. 6: shows a side view of the elements of FIG. 5;

FIG. 7: shows an enlarged view of detail VII from FIG. 5;

FIG. 8: shows an enlarged view of an end portion of a single rotary shaft arranged between two refrigerant guide tubes;

FIG. 9: shows a three-dimensional depiction of the cooling unit of FIG. 1, wherein the majority of the refrigerant guide tubes and rotary shafts have been omitted to illustrate the rotary drive and the linear displacement drive;

FIG. 10: shows a three-dimensional depiction of a single motor of the rotary drive and the rotary shafts driven by said motor; and FIG. 11: shows a side view of the elements of FIG. 10.

FIG. 1 shows an exemplary embodiment of a cooling unit 1 for cold air generation in snow-making systems.

The cooling unit 1 has a substantially box-shaped or cuboid outer contour, which is bounded by a housing frame 2. In the exemplary embodiment shown, the air inlet side is at the bottom and the air outlet side is at the top. The air to be cooled by thus flows through the cooling unit 1 from the bottom upwards in the direction of the arrows 3.

Another orientation of the cooling unit 1, in which the airflow passes through the cooling unit 1 for example from top to bottom or in a horizontal direction, is also conceivable within the scope of the invention.

The cooling unit 1 comprises multiple straight refrigerant guide tubes 4 through which a refrigerant, for example a glycol-water mixture, can be passed. The refrigerant guide tubes 4 are connected at one end to an external chiller, not shown, which cools the refrigerant to a low temperature of, for example, −30° C. The refrigerant cools the refrigerant guide tubes 4 accordingly, which then have a correspondingly cold surface.

In the exemplary embodiment shown, the refrigerant guide tubes 4 are arranged horizontally and parallel to each other with a predetermined spacing in such a way that they form a stack/a bundle. A certain number of refrigerant guide tubes 4, for example 10 to 100 refrigerant guide tubes 4, form a row or tube layer 5 of horizontally adjacently arranged refrigerant guide tubes 4 which lie in a certain horizontal plane. As can be seen from FIG. 1, the cooling unit 1 comprises multiple, for example 20 to 100, tube layers 5 of this kind arranged one above the other.

The cooling unit 1 can thus comprise a very large number of refrigerant guide tubes 4, for example 100 to several thousand. The number is variable to a large extent and is determined by the size of the cooling unit 1 and the desired refrigeration transfer capacity.

The refrigerant guide tubes 4 are preferably stainless steel tubes which have a very exact, constant outer diameter with only very small tolerance deviations over their entire length.

The mutual distance of the refrigerant guide tubes 4 in the vertical direction, i.e. the vertical distance between the individual horizontal tube layers 5, is preferably the same and is advantageously 0.5-4 times, particularly preferably 0.8-2 times, especially 0.9-1.2 times the outer diameter of the refrigerant guide tubes 4.

The mutual distance of the refrigerant guide tubes 4 in the horizontal direction can be the same or different from their vertical distance.

The cooling unit 1 further comprises a de-icing device for mechanically removing ice or frost formed on the refrigerant guide tubes 4. This de-icing device is designed in such a way that it can operate permanently and very effectively during ongoing operation of the cooling unit 1, wherein the cooling and the flow of air through the cooling unit 1 are not or only insignificantly hindered.

FIG. 4 shows the de-icing device without linear displacement drive. The de-icing device comprises multiple rotary shafts 6 arranged one above the other, which are rotatably mounted on both sides in lateral supports 7*a*, 7*b* and can be set in rotation by means of motors 8*a*, 8*b*. The lateral supports 7*a*, 7*b* can together be referred to as a lateral support arrangement. As can be seen in particular from FIG. 2, they extend over the entire height of the stack of refrigerant tubes 4.

As can be seen from FIG. 3, in the exemplary embodiment shown, three motors 8*a* are fastened to the left-hand support 7*a* so that they act on the left-hand end of some rotary shafts 6, while two other motors 8*b* are fastened to the right-hand support 7*b* so that they act on the right-hand end of some rotary shafts 6. Because of the alternating arrangement of the motors 8*a*, 8*b*, a relatively large number of motors 8*a*, 8*b* can be fastened to the side support arrangement so that only a small number of rotary shafts 6 need to be driven by a single motor 8*a*, 8*b*. This reduces the power required per motor 8*a*, 8*b*.

A rotary shaft 6 extends between each two adjacent tube layers 5 transversely to the longitudinal direction of the refrigerant guide tubes 4, as will be explained in greater detail with reference to FIGS. 5 to 8.

The rotary shafts 6 can be moved along the entire length of the refrigerant guide tubes 4 by means of a linear displacement drive acting on the lateral supports 7*a*, 7*b* in a manner shown in FIGS. 1 and 9.

The linear displacement drive comprises two motors 9*a*, 9*b* which are stationarily mounted on a support structure 10 (FIG. 1) in the opposite side regions of the cooling unit 1 and can drive vertical shafts 11 in rotation, each of which is rotationally coupled at the end to a drive pinion 13 (FIG. 9). The drive pinions 13 mesh with four horizontally guided toothed racks 12 which are arranged parallel to one another in the edge regions of the stack of refrigerant guide tubes 4 and are displaced in their longitudinal direction relative to the housing frame 2 by the rotary movement of the drive pinions. Since the toothed racks 12 are firmly connected to the lateral supports 7*a*, 7*b*, the lateral supports 7*a*, 7*b* and thus the rotary shafts 6 are correspondingly entrained and moved along the refrigerant guide tubes 4.

As can be seen from FIGS. 5 to 8, the rotary shafts 6 extend transversely to the longitudinal direction of the refrigerant guide tubes 4. A rotary shaft 6 is provided between each tube layer 5. All rotary shafts 6 are at least substantially the same.

The rotary shafts 6 have two opposing rows of retaining lugs 14 which project radially beyond the tubular or cylindrical shaft body 15 and are preferably welded to the latter. Instead of two rows, another number of rows, for example one to four rows of retaining lugs 14, may also be provided, which are preferably arranged regularly around the circumference of the shaft body 15. The retaining lugs 14 are arranged and designed in such a way that they each project into the intermediate region between two adjacent refrigerant guide tubes 4 with some clearance.

The retaining lugs 14 are used to fasten removal elements 16, which can be used to remove a build-up of ice or frost that has formed on the refrigerant guide tubes 4. For this purpose, the removal elements 16 each have a contour cutting edge 17, i.e. a cutting edge adapted to the circumferential contour of the refrigerant guide tubes 4, which can be guided past the circumference of the refrigerant guide tubes 4 at a very small distance when the rotary shafts 6 are rotated. The removal elements 16 are thus milling elements with which the ice or frost build-up is milled off.

The contour cutting edges 17 of the removal elements 16 protrude beyond the retaining lugs 14. Furthermore, the removal elements 16 extend so far into the space between horizontally adjacent refrigerant guide tubes 4 that the contour cutting edges 17 enclose up to half of the circumference of the refrigerant guide tubes 4 with a narrow spacing when the removal elements 16 are aligned vertically.

The removal elements 16 of a row arranged next to each other thus form a removal strip 18, which has semi-circular indentations formed by the contour cutting edges 17 and spaced apart according to the spacing of the refrigerant guide tubes 4, and fastening portions 19 arranged between the indentations.

The fastening means for fastening the removal elements 16 to the retaining lugs 14 are not shown in detail in FIGS. 7 and 8. The fastening means may in particular consist of screws which are passed through bores 20 provided in the retaining lugs 14 and fastening portions 19 of the removal elements 16. The fastening means can in particular be designed in such a way that the removal elements 16 are mounted on the retaining lugs 14 in a floating manner, i.e. with some lateral flexibility. This can be realised, for example, by sleeve-like rubber inserts that are inserted into the holes 20.

The removal elements 16 of a row can be integrally formed in the form of a single continuous removal strip 18 extending over the entire width of a tube layer 5. Alternatively, it is also possible for a removal strip 18 to be formed by individual removal elements 16 separated from each other or by several groups of continuous removal elements 16. In the case of separate removal elements 16, it is expedient if the dividing line is located in the centre of the contour cutting edges 17, i.e. at the deepest point of the indentations.

As can be seen in particular from FIG. 6, adjacent rotary shafts 6 arranged one above the other are offset from one another in the longitudinal direction of the refrigerant guide tubes 4. This means that the removal elements 16 of adjacent rotary shafts 6 cannot touch each other even if they extend beyond half of the tube circumference. The rotary shafts 6 are arranged in two parallel, spaced vertical planes.

With reference to FIGS. 10 and 11, the rotary drive for the rotary shafts 6 is explained in greater detail, with a single motor 8*a* and the rotary shafts 6 driven by this motor 8*a* being shown.

Each rotary shaft 6 has an end portion 21 to which at least one sprocket 22, 23 is fastened for conjoint rotation. The sprockets 22, 23 can also be toothed pulleys. In the illustrated exemplary embodiment, a total of nine rotary shafts 6 arranged one above the other are driven by a single motor 8*a*.

The drive is provided by four drive chains 24*a*, 24*b*, 24*c*, 24*d* or corresponding toothed belts, which are only shown schematically. Each drive chain 24*a*, 24*b*, 24*c*, 24*d* runs over the sprockets 22, 23 of three rotary shafts 6 arranged one above the other as well as over a tensioning sprocket 25, with which the tension of the drive chains 24*a*, 24*b*, 24*c*, 24*d* can be adjusted.

The third, fifth and seventh rotary shafts 6, counted from the bottom in FIGS. 10 and 11, each carry two sprockets 22, 23 arranged one behind the other. The drive chains 24*a*, 24*c* are engaged here with the front sprockets 22, while the drive chains 24*b*, 24*d* are engaged with the rear sprockets 23. In this way, all nine rotary shafts 6 are rotationally coupled to each other.

The rotary drive can thus be realised in that one of the rotary shafts 6, in the illustrated exemplary embodiment the fifth rotary shaft 6 from the bottom, is coupled in a rotationally fixed manner to the output gear shaft of the motor 8*a*, which is not shown in greater detail. The other eight rotary shafts 6 are then rotated accordingly.

FIG. 9 also shows suggestively that the refrigerant guide tubes 4 are guided through end plates 26, which are designed as perforated plates. The refrigerant guide tubes 4 are hereby positioned radially. The end plates 26 form the end of the displacement path for the rotary shafts 6.

In order to allow a radial expansion of the refrigerant guide tubes 4 in the event of temperature fluctuations and a certain degree of flexible mounting in the radial direction, the refrigerant guide tubes 4 are preferably mounted floatingly in the end plates 26, for example by means of an elastic O-ring.

The invention claimed is:

1. A cooling unit for cold air generation, having a plurality of tube layers of refrigerant guide tubes and having a mechanically acting de-icing device for removing ice and frost build-up from the refrigerant guide tubes, the de-icing device comprising removal elements which are displaceable along the refrigerant guide tubes, wherein the de-icing device comprises at least one rotary shaft, which extends between two tube layers transversely to the refrigerant guide tubes and is displaceable linearly in a longitudinal direction of the refrigerant guide tubes, and a rotary drive for rotating the rotary shaft, and in that the removal elements are designed as rotary elements fastened to the rotary shaft, which remove the ice and frost build-up from the refrigerant guide tubes by means of a rotary movement, wherein the removal elements have contour cutting edges which form a cutting edge profile configured to match an outer profile circumference of the refrigerant guide tubes, each removal element extends over at least one third of the outer profile circumference of the refrigerant guide tubes, and wherein the removal elements rotate and linearly translate along the refrigerant guide tubes.

2. The cooling unit according to claim 1, wherein the removal elements are made of a metal that has a lower hardness than the refrigerant guide tubes, or in that the removal elements have scraper lips on which contour cutting edges are formed and which are made of a hard plastic or hard rubber or of a metal that has a lower hardness than the refrigerant guide tubes.

3. The cooling unit according to claim 1, wherein the removal elements are designed in such a way that the contour cutting edges are at a distance of 0.5 to 3 mm from the refrigerant guide tubes.

4. The cooling unit according to claim 1, wherein the removal elements are designed as brushes.

5. The cooling unit according to claim 1, wherein the removal elements are flexibly mounted on the rotary shaft in such a way that the position of the removal elements relative to the rotary shaft can be adapted to a position of the refrigerant guide tubes.

6. The cooling unit according to claim 1, wherein the rotary shaft has radially projecting retaining lugs, on which the removal elements are retained.

7. The cooling unit according to claim 1, wherein the removal elements are integrally formed in the form of a removal strip that can be fastened along the rotary shaft.

8. The cooling unit according to claim 7, wherein the removal strip extends over the refrigerant guide tubes of a tube layer.

9. The cooling unit according to claim 1, wherein the multiple tube layers arranged one above the other, between each of which the rotary shaft with the removal elements is arranged, adjacent rotary shafts being arranged offset in the longitudinal direction of the refrigerant guide tubes.

10. The cooling unit according to claim 1, wherein the rotary shaft is rotatably mounted at an end on a side support arrangement which is movable in a longitudinal direction of the refrigerant guide tubes, the rotary drive being fastened to the side support arrangement and being movable together therewith.

11. The cooling unit according to claim 10, wherein the rotary drive comprises at least one motor which drives a plurality of rotary shafts together via a transmission.

12. The cooling unit according to claim 1, wherein the refrigerant guide tubes are radially floatingly mounted in end plates which are designed as perforated plates.

13. The cooling unit according to claim 12, wherein the end plates are heated.

* * * * *